US005335576A

United States Patent [19]

Hayashi

[11] Patent Number: 5,335,576

[45] Date of Patent: Aug. 9, 1994

[54] PICKUP FOR GUITAR

[76] Inventor: Nobuaki Hayashi, 5882-2 Sasaga, Matsumoto, Nagano, Japan

[21] Appl. No.: 981,829

[22] Filed: Nov. 25, 1992

[51] Int. Cl.[5] ..... G10H 3/14

[52] U.S. Cl. ..... 84/727

[58] Field of Search ..... 84/726–728

[56] References Cited

U.S. PATENT DOCUMENTS

| | | | |
|---|---|---|---|
| 2,933,967 | 4/1960 | Riscol | 84/726 |
| 4,188,849 | 2/1980 | Rickard | 84/726 |
| 4,254,683 | 3/1981 | Nulman | 84/DIG. 3 X |
| 4,580,481 | 4/1986 | Schaller et al. . | |
| 4,995,292 | 2/1991 | Nomura | 84/726 |
| 5,012,716 | 5/1991 | Pagelli | 84/727 |

*Primary Examiner*—William M. Shoop, Jr.
*Assistant Examiner*—Jeffrey W. Donels

[57] ABSTRACT

A pickup for a guitar comprises a magnet body formed integrally from a cylindrical cover and a magnet bobbin, a holder mounted within an aperture provided on a front side of a main body of the guitar and provided with a plurality of click-stop slits, and a holder securing plate mounted on the rear side of the aperture, wherein the magnet body supported rotatably within the holder is adapted to change the tone picked up from the string and is mounted so that protrusion of the magnet body vertically in relation to the holder can be adjusted by an adjusting screw for changing the output of the guitar.

4 Claims, 3 Drawing Sheets

PICKUP FOR GUITAR

BACKGROUND OF THE INVENTION

This invention relates to a pickup for guitars, more particularly to a power-adjustable pickup embedded within a main body of an electric guitar.

In conventional electric guitars, pickups for picking up sounds or vibrations of the metal strings to be amplified by an amplifier are embedded below the strings within the main body of the electric guitar and are adapted to have their gaps from the strings adjusted to effect a power adjustment of the pickup in order to generate the sounds most desired by the player.

However, in such prior pickups for electric guitars, since the pickup consists of a plurality of magnet bobbins embedded within an elongate mounting member on the guitar at spaces related to the spaces between the strings, the whole pickup being moved up-and-downward to adjust the power relative to all of the strings by the change in the space between the strings and the pickup, separate adjustment of the tone for each string has been impossible.

Therefor, the .object of the invention is to provide a pickup for a guitar that is capable of adjusting the tone for each of the strings by embodding pick-ups capable of up-and-downward movement and of required rotation having magnet bobbins respectively within a main body of the guitar for each of the strings in order to solve the above-mentioned problems for the prior art.

SUMMARY OF THE INVENTION

To establish the above object, in accordance with the invention, there is provided a pickup for a guitar comprising a magnet body formed integrally from a cylindrical cover and a magnet bobbin, a holder mounted within an aperture provided on a front side of a main body of a guitar and provided with a plurality of slits for click-stops, and a holder securing plate mounted on the rear side of the aperture, the magnet body being supported rotatably within the holder and mounted so that the protrusion of the magnet body can be adjusted vertically in relation to the holder by an adjusting screw.

In a preferred embodiment of the present invention, since the magnet body is supported rotatably within the holder and is mounted so that protrusion of the magnet body can be adjusted vertically in relation to the holder by the operation of the adjusting screw so that the output of the guitar can be adjusted to accommodated the preferences of the player by the adjustment of the gap between the magnet and the string, and so that the tone of the guitar can be changed as desired by the change of the rise of the magnetic line of force of the magnets against the string by rotating the magnet body into the desired angle.

BRIEF DESCRIPTION OF DRAWINGS

For illustrative purposes only, an embodiment of the invention will be described with reference to the accompanying drawings of which.

DESCRIPTION OF THE PREFERRED EMBODIMENT OF THE INVENTION

Figure 1:
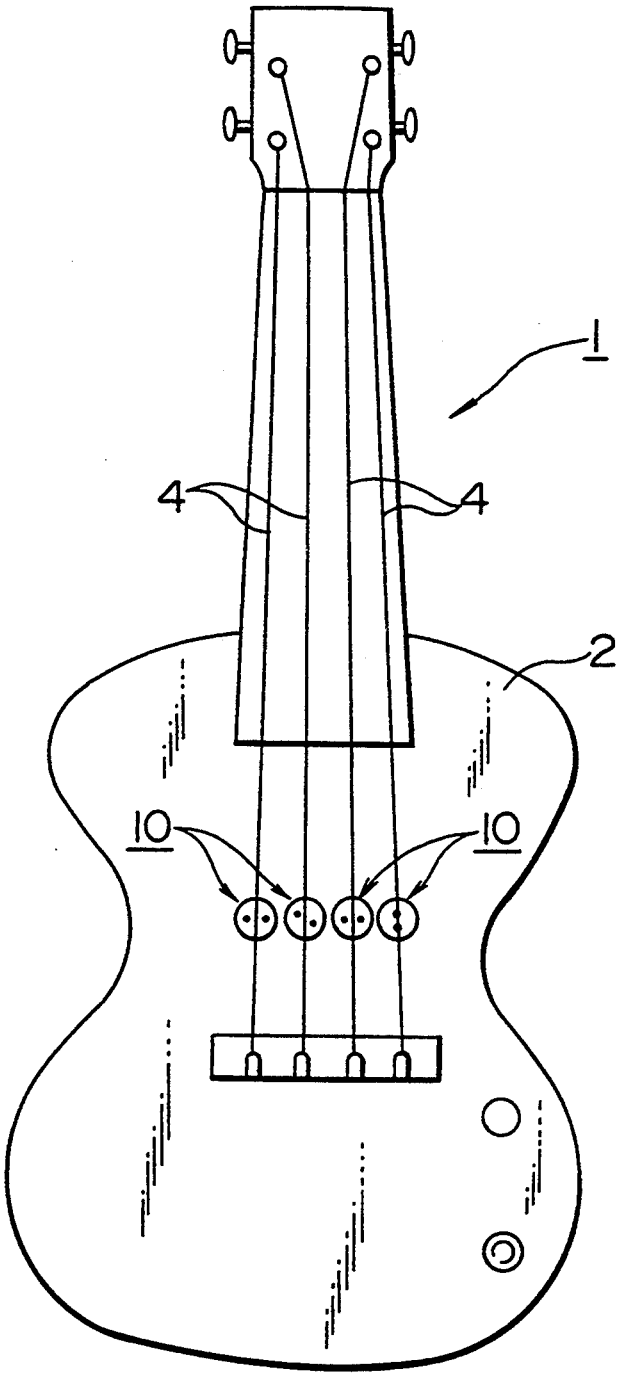
FIG. 1 is a schematic elevational view of a guitar provided with the pickups of this invention.

As shown in FIG. 1, pickups 10 for a guitar of the present invention are mounted into a line of apertures 3 provided in a main body 2 of a guitar 1 below each string 4 as shown.

Figure 2:
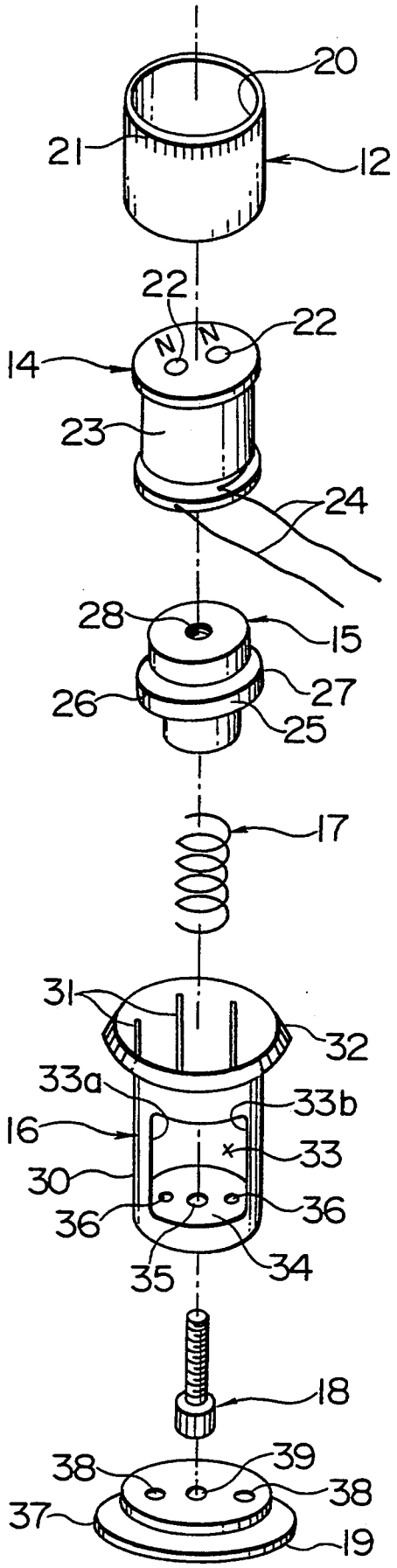
FIG. 2 is an exploded perspective view of the pickup for the guitar of the present invention.
Figure 3:
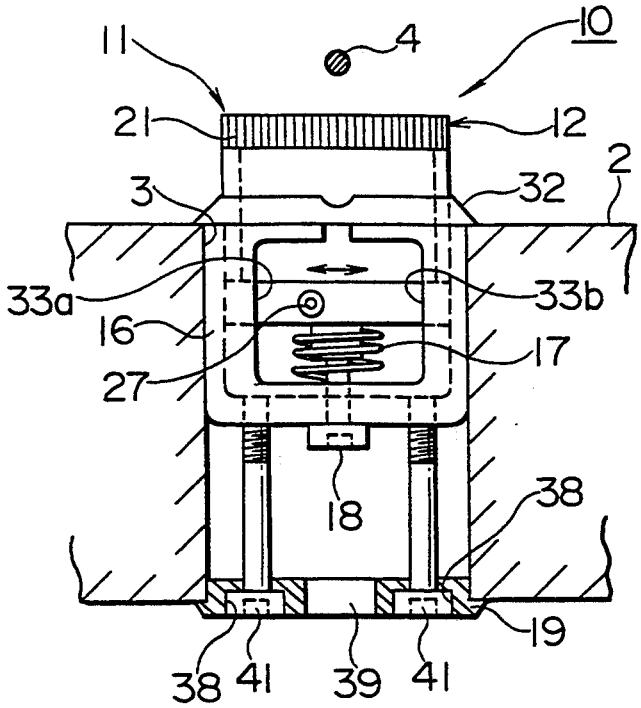
FIG. 3 is a vertical cross-sectional view.

As clearly shown in FIGS. 2 and 3, each of the pickups 10 of the guitar for the present invention consists of a magnet body 11 formed integrally from a cylindrical cover 12 and a magnet bobbin 14, a holder 16 mounted within an aperture 3 provided on a front side of a barrel 2 of the guitar 1 and is provided with a plurality of slits 31 for click-stops, and a plate 19 for securing the holder 16 mounted on the rear side of the aperture 3 on the barrel 2 of the guitar 1, and an adjusting screw 18 for mounting the magnet body 11 within the holder 16 capable of adjusting the protrusion of the magnet body 11 vertically in relation to the holder 16.

As clearly shown in FIGS. 2 and 3, the magnet body 11 is integrally comprised from the cylindrical cover 12, the magnet bobbin 14 and a bottom member 15. The cover 12 is a hollow cylindrical shape and is provided partially with a vertical slit 20 on its upper portion and a knurled portion 21 on the outer periphery of its upper end. The magnet bobbin 14 is comprised of a pair of magnets 22 wound with a coil 23 having lead lines 24. The bottom member 15 is comprised of a member having a flange 25 provided with a spring plunger 26 formed from a small ball and a spring, a set screw 27 and a threaded vertical hole 28 for the vertically adjusting screw 18 engaged therethrough at its central portion.

The holder 16 is formed from a hollow cylinder portion 30 and a bottom wall 34 and is provided with an inclined flange 32 at the upper end of the cylinder portion 30 and a plurality of slits 31 (only three slits shown this embodiment) extending vertically thereon. The cylinder portion 30 is also provided with an opening 34 for the stopper 27 for restricting the rotary movement of the magnet body 11 and with an aperture 35 for the adjusting screw 18 on the center of the bottom wall 34. Both side edges 33*a* and 33*b* of the opening 33 operate as stoppers for the set screw 27 upon the rotation of the magnet body 11 by the engagement thereof. The slits 31 for the click-stop are provided on the inner periphery of the holder 16 at a spaced angle associated to a rotation of 45° of the magnet body 11 in the embodiment to restrict the rotation of the magnet body 11 to 45° with the desired click-stop movement. If desired, the set screw 27 and the opening 34 can be omitted to leave only the click-stop of the magnet body 11 with the slits 31 to determine the desired rotary spaces.

The plate 19 for securing the holder 12 is in a lid shape and is provided with an inclined flange 37 on its lower end, spot faced apertures 38 for screws 141 securing the holder 16 and a central aperture 39 for adjusting the screw 18.

The pickup 10 constructed as mentioned above is snugly fitted within the aperture 3 of the barrel 2 of the guitar 1 from its front side, the spring 17 is inserted within the holder 16, the magnet body 11 formed integrally from the cover 12, the magnet bobbin 14 and the bottom member 15 is fitted rotatably within the holder 16, and while the spring 17 is compressively held between the bottom member 15 of the magnet body 11 and the bottom wall 34 of the holder 16 the adjusting nut 18 is screw-engaged within the threaded aperture 28 on the bottom member 15 of the magnet member 11 through the aperture 35 on the bottom wall 34 of the holder 16. Thus, with the rotation of this adjusting screw 18 the magnet body 11 can be moved in the up-and-down direction against the spring 17 as desired, and further the magnet body 11 can be rotated by holding the knurled portion 21 of the cylindrical cover 12 of the magnet body 11 and rotating it to the desired angle associated with the slit 31 for click-stop. Finally, the plate 19 for securing the holder 16 is mounted on the rear side of the aperture 3 of the barrel 2 of the guitar 1, and is secured by the screws 41 inserted through the spot faced apertures 38 into threaded apertures 36 on the bottom wall 34 of the holder 16, thereby completing the mounting of the plate 19.

Figures 4A, 4B, 4C:
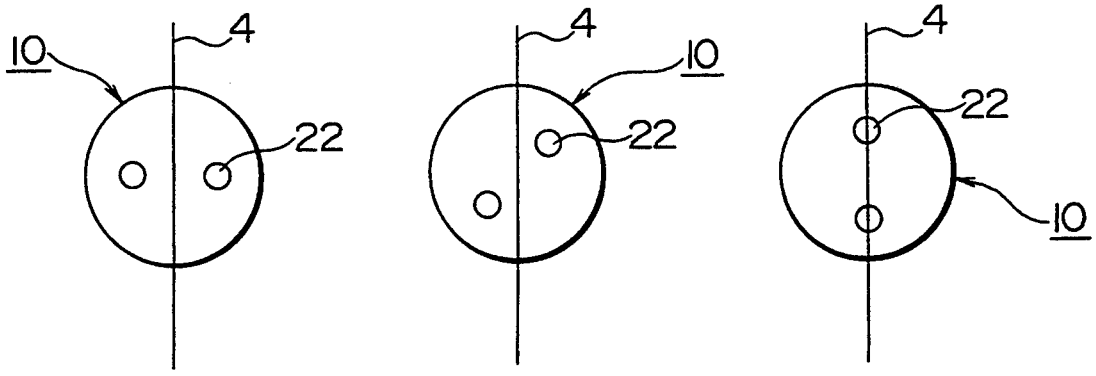
FIGS. 4*a*, 4*b* and 4*c* are partial plane views showing the relationships of the pickup and the string.

As mentioned above, with the pickup of the guitar for the present invention each of the pickups is provided for the strings is capable of being rotated at angles of 45° by holding the magnet body of the pickup and thus two magnets can be positioned in the desired positions as shown in FIGS. 4*a* to 4*c* so as to change the rising of the magnetic line of force relative to the string. This causes changes in the magnetic field and thereby the tone of the string. Furthermore, the protrusion of the magnet body above the holder can be adjusted by the rotation of the adjusting screw through the central aperture of the plate from the rear side of the barrel of the guitar, and the gap between the string and the magnets can be adjusted appropriately, to thereby allow for the effective adjustment of the power.

It is claimed:

1. A pickup for a string of an electric guitar, said pickup being mounted in an aperture in a front side of a main body of the guitar proximate the string, said pickup comprising:

a holder mounted in the aperture;

a magnet body mounted in the holder, said magnet body being rotatable in the holder and movable inwardly and outwardly of the holder, said magnet body including a bobbin and a cylindrical cover disposed around the bobbin; and adjusting means for adjusting the position of the magnet body and varying the distance between the magnet body and the string.

2. The pickup of claim 1, wherein the holder includes stop means for stopping the magnet body in one of several positions as it rotates within the holder.

3. The pickup of claim 1, wherein the holder includes limit means for limiting the rotation of the magnet body within predetermined limits.

4. An electric guitar comprising:

a body;

a plurality of strings mounted on the body;

a pickup for each string, each pickup disposed in an aperture defined by the guitar body proximate a corresponding string, each pickup including electromagnetic means for receiving sounds or vibrations from a string, and means for adjusting the position of the electromagnetic means and varying the distance between the pickup and a corresponding string;

said electromagnetic means including:

a holder mounted in the aperture, a magnet body mounted in the holder, said magnet body being rotatable in the holder and movable inwardly and outwardly of the holder, said magnet body including a bobbin and a cylindrical cover disposed around the bobbin.

* * * * *